US008556498B2

(12) United States Patent
Dennen et al.

(10) Patent No.: US 8,556,498 B2
(45) Date of Patent: Oct. 15, 2013

(54) METHOD FOR SCALING MIXING OPERATIONS

(75) Inventors: Thomas Dennen, Malden, MA (US); Venkatesh Natarajan, Arlington, MA (US)

(73) Assignee: EMD Millipore Corporation, Billerica, MA (US)

( * ) Notice: Subject to any disclaimer, the term of this patent is extended or adjusted under 35 U.S.C. 154(b) by 831 days.

(21) Appl. No.: 12/775,604

(22) Filed: May 7, 2010

(65) Prior Publication Data

US 2011/0116342 A1 May 19, 2011

Related U.S. Application Data

(60) Provisional application No. 61/176,974, filed on May 11, 2009.

(51) Int. Cl.
*B01F 13/00* (2006.01)

(52) U.S. Cl.
USPC ..... 366/348; 366/349

(58) Field of Classification Search
USPC ..... 366/142, 143, 348, 349
See application file for complete search history.

(56) References Cited

U.S. PATENT DOCUMENTS

| | | | | |
|---|---|---|---|---|
| 6,096,872 | A * | 8/2000 | Van Holten et al. | 530/390.1 |
| 6,395,516 | B1 * | 5/2002 | Nienow et al. | 435/91.1 |
| 6,568,844 | B1 | 5/2003 | Arthun et al. | |
| 7,270,744 | B2 * | 9/2007 | Petersen et al. | 210/85 |

OTHER PUBLICATIONS

International Search Report and Written Opinion dated Jul. 16, 2010 in co-pending application PCT/US10/033981.
International Preliminary Report on Patentablity/Written Opinion mailed Nov. 24, 2011 in corresponding PCT application No. PCT/US2010/033981.

* cited by examiner

*Primary Examiner* — Tony G Soohoo
*Assistant Examiner* — Anshu Bhatia
(74) *Attorney, Agent, or Firm* — Nields, Lemack & Frame, LLC

(57) ABSTRACT

A method for determining mixing time for a variety of vessels is disclosed. This method utilizes information about the configuration, such as vessel diameter, impeller diameter and speed, fluid density and viscosity, and fluid height to determine the appropriate mixing time. In another embodiment, the parameters used to create small batches of material can be used to scale up to larger vessel sizes.

14 Claims, 15 Drawing Sheets

METHOD FOR SCALING MIXING OPERATIONS

This application claims priority of U.S. Provisional Patent Application No. 61/176,974, filed May 11, 2009, the disclosure of which is incorporated herein by reference in its entirety.

BACKGROUND OF THE INVENTION

Often, compounds are mixed together to create a new or desired result. For example, buffers, chemicals and other compounds are often combined to create process intermediates in downstream processing of biologics. For example, in some formulations, it is common to mix together various solutes. Solutes are mixed typically in large vessels, which utilize impellers located within the vessel, driven by electric motors. Impellers are typically designed to be used with a specific vessel size and shape. The size, shape and speed at which the impeller turns all factor into determining how quickly the compound will mix.

In some embodiments, the mixing combination is liquid/liquid, where one liquid is mixed into a second liquid. Common examples are the introduction of a base or an acid into a solution. Another specific combination is dissolution of a solute soluble in a particular solvent. In both scenarios, it is imperative that the two materials are completely mixed. For example, incomplete mixing of a base into a solution may leave the volume of fluid nearest the entry point of the base at a higher pH than the rest of the solution, thereby impacting the homogeneity of the solution.

Since it is imperative that the solution be homogeneous, developers often spend significant time determining the required mixing time and mixing methodology so that the homogeneity of the solution is uniform. One way to determine this mixing time is through empirical testing. For example, FIG. 1 shows the typical pH response of a solution to which a base, such as NaOH, has been added at the top of the vessel. Line 10 shows the pH of the solution near the top surface. Note that the pH quickly rises, as the base has added near the pH probe. Since the base was added near the probe, the measured pH actually exceeds the resulting pH (indicating a non-uniform concentration of base) until the base is thoroughly mixed. The vertical lines, at approximately 3 seconds and 19 seconds are used to delineate the time required for the top surface to reach the proper pH level. Line 20 shows the pH of the solution near the bottom of the vessel. Since the base has added near the top, it takes some time until the base reaches the bottom probe. This explains the lag in the response seen in line 20, with respect to line 10. The pH begins to increase at about 10 seconds and mixing is completed at about 26 seconds. Lines 30 and 40 represent a second test using the same configuration, which yielded similar results. Mixing time is determined as the time between the start of the change in the response curve and the time at which the top and bottom curves were both within 5% of the steady state value. In this specific example, the mixing time is about 16 seconds for both runs.

In many cases, when developing new solutions, developers utilize very small batch sizes. Once the developers are assured that the formulation is correct, the solution enters the next phase. This may be scaled up for implementation into the remaining downstream processes, or to begin testing of the solution as a final product. This testing may involve viability and usability of the solution as a final product, patient tests if it is a pharmaceutical, or official governmental review, such as by the FDA to ensure the product meets the required specifications. Once the testing has been approved, the solution moves from the developmental stage to the manufacturing stage for implementation into production stage.

In the production stage, the uniform solution is produced in much larger volumes. Typically, this necessitates the need for larger vessels to be used in the manufacture of the solution. However, the processes that were originally used to create the smaller batches may not always suitable for longer containers nor does the mixing process respond in a similar manner to that of a smaller scale mixing.

Often, the parameters, such as mixing time, for a small vessel cannot be easily scaled to accommodate a large vessel. For example, the mixing time does not scale linearly with vessel capacity. This results in uncertainty in the manufacturing stage, non-reproducibility of the process (hampering validation efforts), and may significantly increase the amount of time to verify the satisfactory completion of the processing time. It would be advantageous if there were a method of determining mixing time for a larger vessel based on predefined known parameters, such as vessel size and impeller RPM. Furthermore, it would be beneficial if this process allowed a verified and previously defined process used with a smaller vessel to be predictably scaled up to a larger vessel.

SUMMARY OF THE INVENTION

The problems of the prior art are overcome by the present invention, which discloses a method for determining mixing time for a variety of vessels. This method utilizes information about the configuration, such as vessel diameter, impeller design, diameter and speed, fluid density, viscosity and other liquid properties, along with fluid height to determine the appropriate mixing time. In another embodiment, the parameters used to create small batches of material can be used to scale up to larger vessel sizes.

DETAILED DESCRIPTION OF THE INVENTION

As stated above, often the parameters and mixing time used to create small batches of a solution are not suitable or reproducible for larger production batches.

Figure 1:
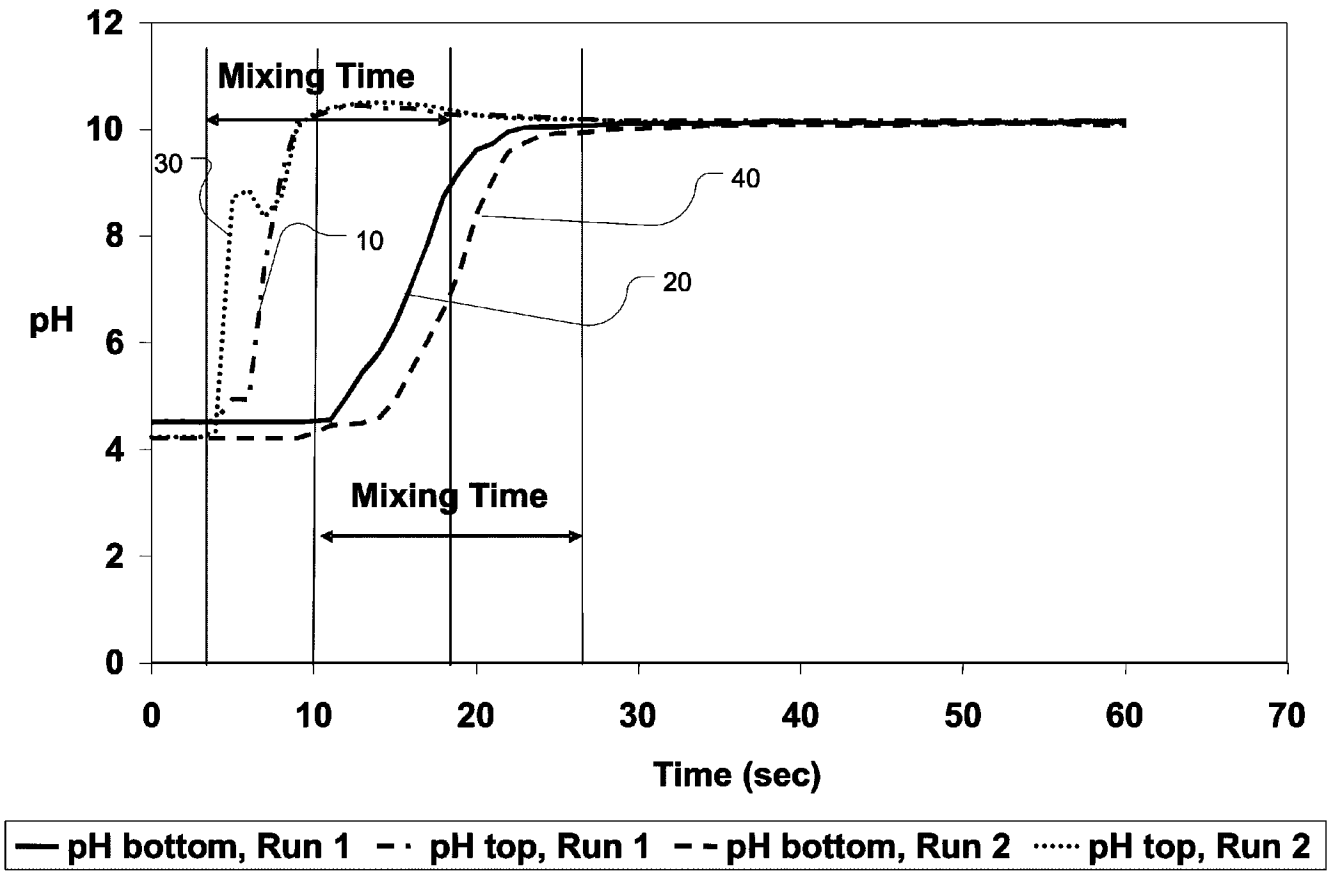
FIG. 1 represents a graph demonstrating mixing time for a base being added to solution.
Figure 2:
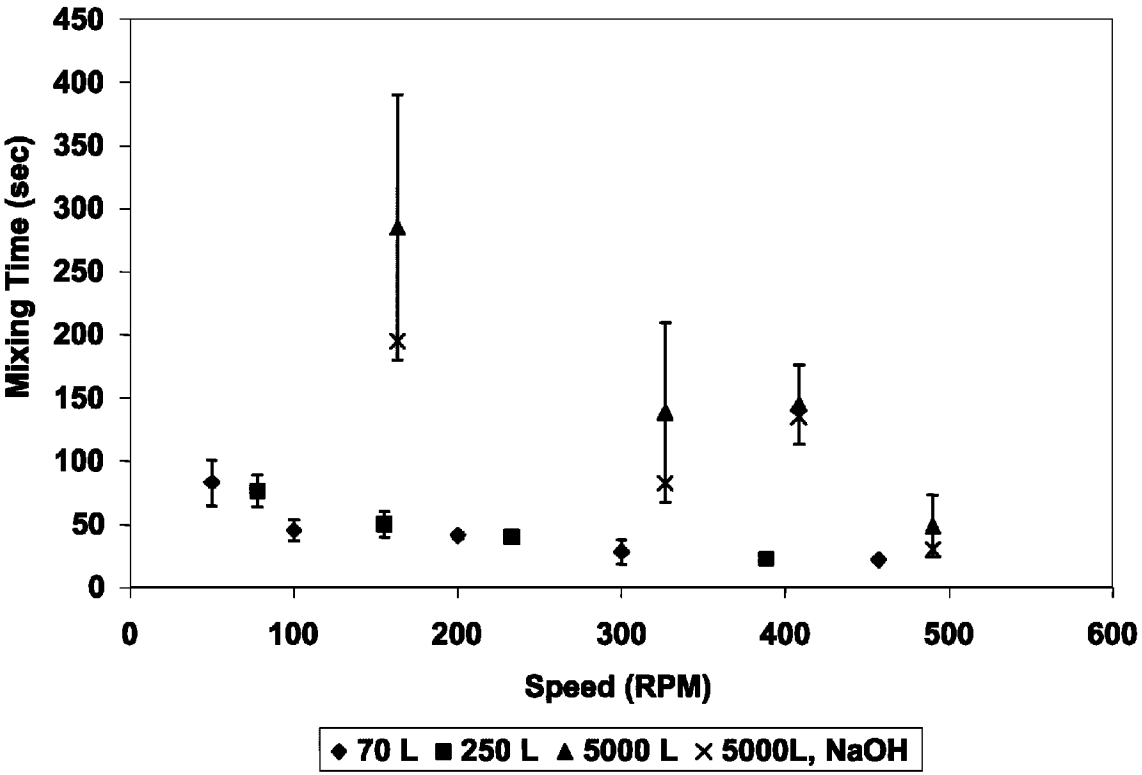
FIG. 2 represents a graph showing mixing time as a function of impeller speed and vessel size.

For example, FIG. 2 shows a graph of mixing time as a function of impeller speed for a variety of different sized vessels. All data was taken using a particular impeller design, known as a GMP series impeller. In this Figure, a base, such as NaOH, was added to a solution of water, and the mixing times were measured empirically, as was described in connection to FIG. 1. While water and NaOH were used, the invention is not limited to this embodiment, as other solutions and other acids and bases could also be used in accordance with this invention. The diamonds represent the mixing times when a 70 liter (70 L) vessel is used. The squares represent the mixing times for a 250 liter (250 L) vessel, and the triangles represent the times for a 5000 liter (500 L) vessel. As is easily seen in this figure, mixing times for 5000 L vessels are much greater than those for smaller vessels. However, the difference in mixing times between 70 L and 250 L vessels is typically quite small.

Figure 11:
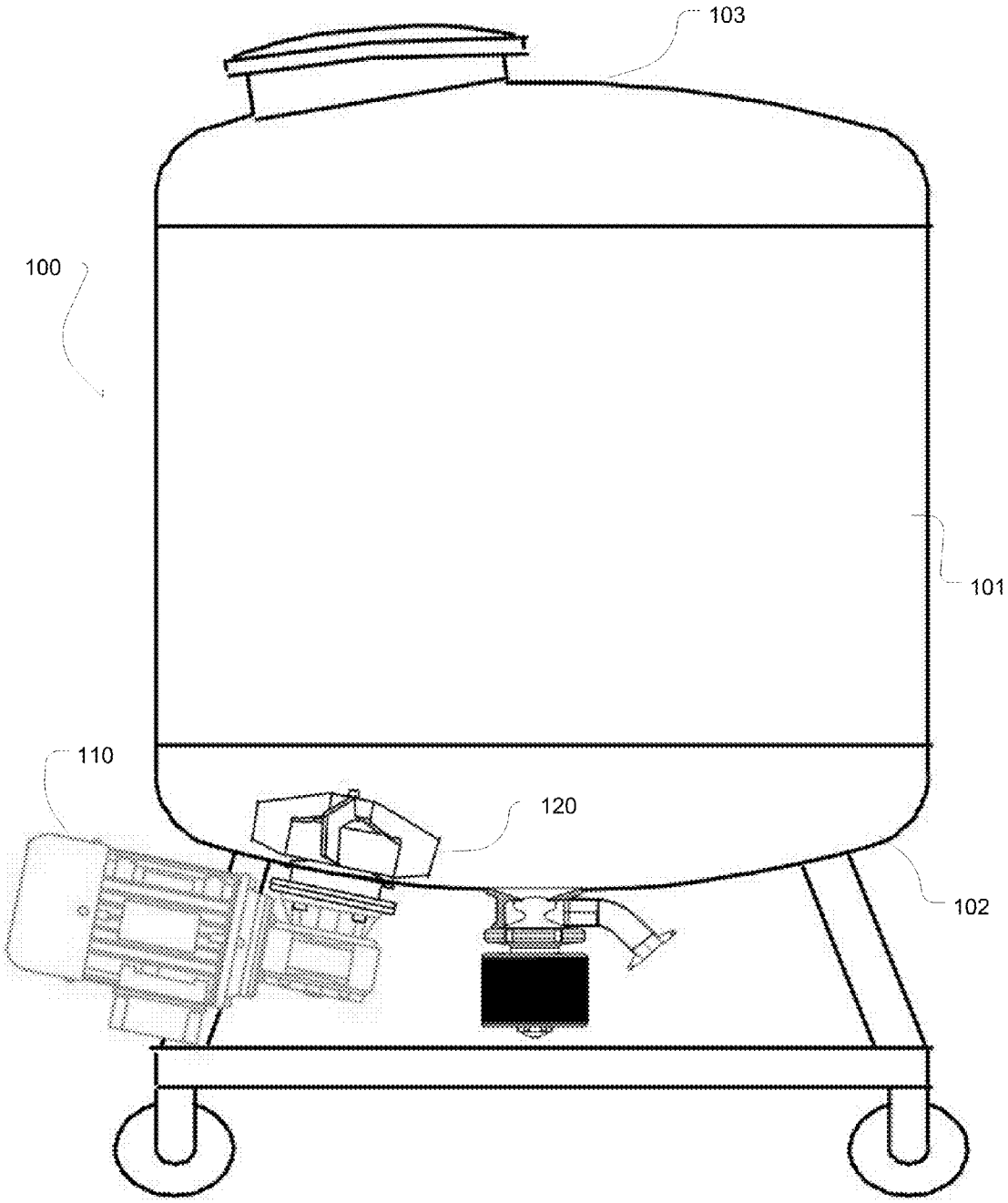
FIG. 11 shows a vessel, mixer and impeller that may be used with the present invention.

Throughout this disclosure, reference is made to 70 L, 250 L and 5000 L vessels. However, other sized vessels may be used and are within the scope of the invention. A representative vessel 100 is shown in FIG. 11. Each of these vessels is generally cylindrical in shape through its midsection 101, with a tapered bottom end 102. Some vessels may include a tapered top end 103. Other vessels may have an open top end. The dimensions of these cylinders determine the capacity of the vessel 100. For example, a 70 L vessel may have a height of about 600 mm (not including the tapered bottom end) and an inner diameter of about 395 mm. A 250 L vessel may have a height of about 820 mm (not including the tapered bottom end) and an inner diameter of about 644 mm. Finally, a 5000 L vessel may have a height of about 1930 mm (not including the tapered bottom end) and an inner diameter of about 1828 mm.

FIG. 11 shows a sample configuration. Other similar cylindrical geometries of different height to diameter ratios also apply. To mix in the solute, a mixer 110 is used, having an impeller 120. The mixer 110 is a motor capable of various rotational speeds. This motor is typically selected based on vessel capacity, fluid viscosity and other parameters. The impeller 120 used is a mixing head that serves to mix the fluid. While various mixers and impellers may be used, in this disclosure, the 70 L vessel was used in conjunction with a NovAseptic® Mixer Assembly Model Number GMP-GM05-10120, which utilizes a NovAseptic® Mixer Model Number GMP50. This Mixer Assembly utilizes an impeller 120 with a diameter of about 96 mm. The 250 L vessel used a NovAseptic® Mixer Assembly Model Number GMP-GM5-10120, which utilizes a NovAseptic® Mixer Model Number GMP500. This Mixer Assembly utilizes an impeller with a diameter of about 142 mm. The 5000 L vessel used a NovAseptic® Mixer Assembly Model Number GMP-GM50-22110, which utilizes a NovAseptic® Mixer Model Number GMP5000. This Mixer Assembly utilizes an impeller with a diameter of about 192 mm. Other vessels, mixers, and impellers may be used and are within the scope of the present invention.

Returning to FIG. 2, note that the mixing time is highly dependent on impeller speed and vessel size. There are certain trends that can be seen. Typically, mixing time decreases with an increase in RPM, although this decrease is not uniform across vessels. Furthermore, the variability of the mixing time (as shown by the brackets) decreases as the RPM increases. In other words, increased agitation improves the repeatability of the test. However, an obvious relationship between impeller speed, vessel size and mixing time has not previously been uncovered.

Figure 3:
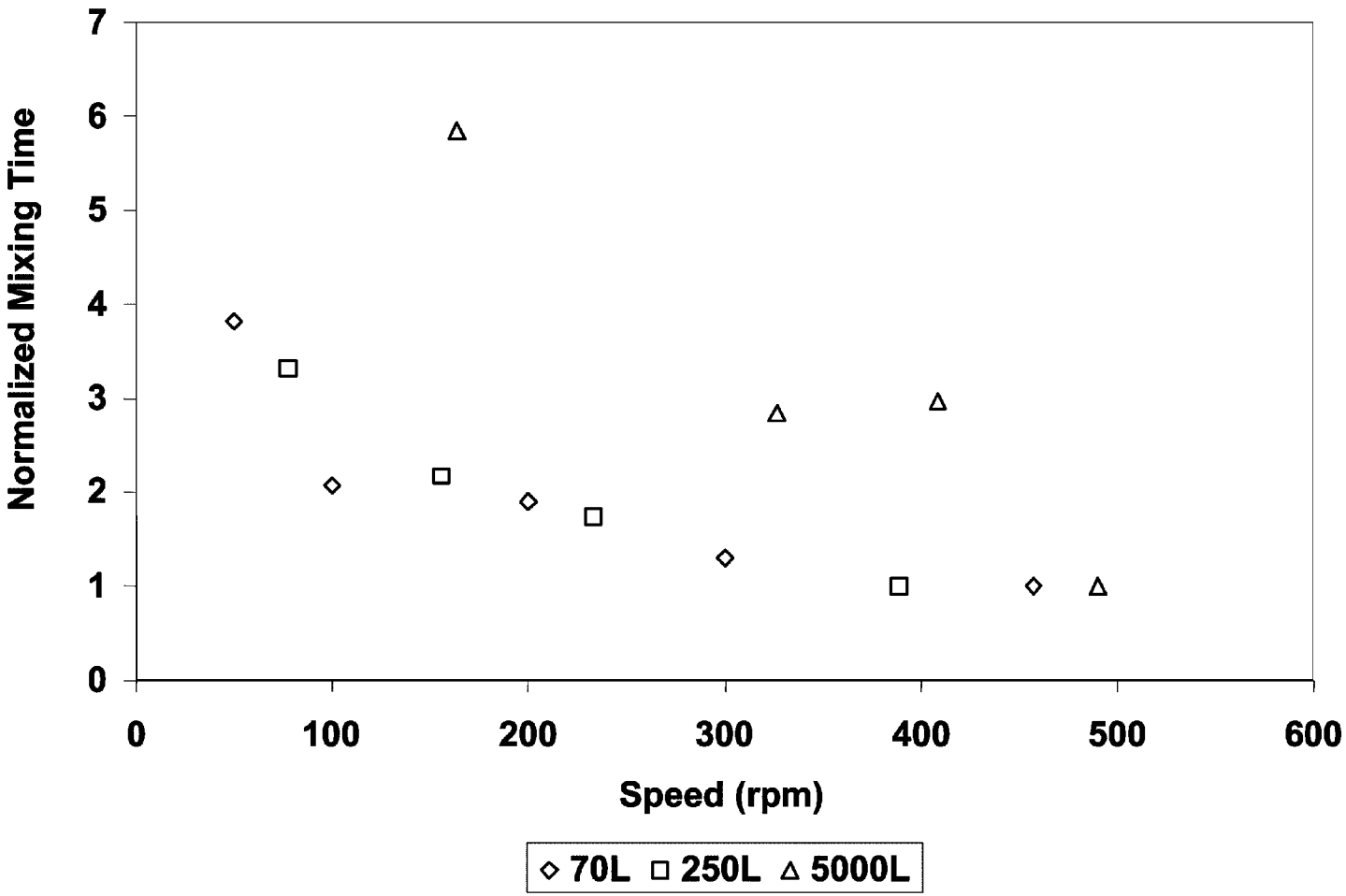
FIG. 3 shows a normalized graph of FIG. 2.

FIG. 3 shows another view of FIG. 2, in which the fastest mixing time for each vessel has been normalized to a value of 1. In other words, in FIG. 2, the fastest mixing time for a 70 L vessel was at about 450 RPM. Thus, this point on FIG. 3 is set to a value of 1. All other values of 70 L are then expressed using a multiplication factor of this fastest time. In other words, the mixing time at 50 RPM for a 70 L was about 3.9 times longer than the mixing time at 450 RPM. This procedure was also followed for the mixing times associated with 250 L and 5000 L vessels. Note that there is no relationship between mixing time and RPM that can readily be established across multiple vessels.

One common theory is that there is a relationship between mixing time and the expression P/V, where P is the impeller power and V is the vessel volume. Impeller power can be calculated in a number of ways. In the present disclosure, the power supplied to the impeller was calculated empirically using information determined via an electrical measurement device, such as a multimeter. The power was then determined as:

$$P=1.732[I][V][PF] \quad (1)$$

Where: I is the measured current,

V is the measured voltage, and

PF is the power factor for the motor (as recited on the faceplate of the motor).

Figure 4:
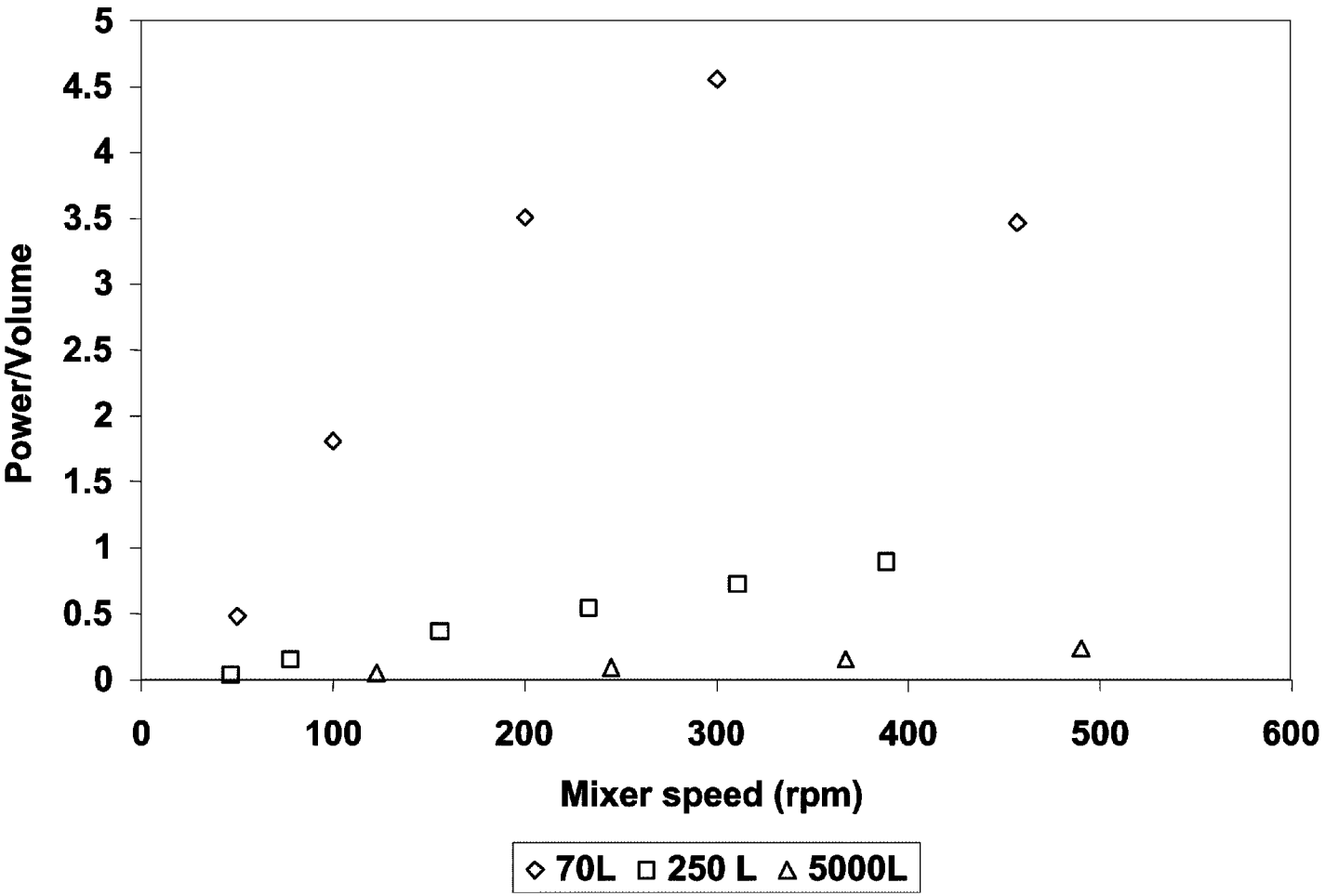
FIG. 4 represents a graph showing P/V as a function of impeller RPM for various vessel sizes.

FIG. 4 shows a graph of P/V as a function of mixer speed for three vessels. Note that the P/V values for the smallest vessel (70 L) are by far the largest, and are, in many cases, at least a factor of 3 greater than the other vessels. However, the data from FIG. 2 shows that the mixing times for 70 L and 250 L vessels are not significantly different. In other words, the significant difference in P/V between 70 L and 250 L vessels is not reflected in the actual mixing times. Since there appears to be no clear relationship between P/V and mixing time, this relationship may not be appropriate when attempting to scale a mixing process from 70 L to larger vessels.

As described earlier, a second type of mixing combination is solute dissolution in a solvent. In this disclosure, water was used as the solvent, and NaCl was used as the solute. However, the disclosure is not limited to water as the only solvent nor NaCl as the only solute, as other solvents and soluble solutes would behave in a similar manner.

To measure mixing time, the conductivity of the solution was probed. Since salt water has a greater conductivity than water, an increase in conductivity results by the addition of NaCl. As was done with respect to FIG. 1, the NaCl was added to the top of the vessel. Since NaCl is heavier than water, it sinks to the bottom before being dissolved into the water.

Figure 5:
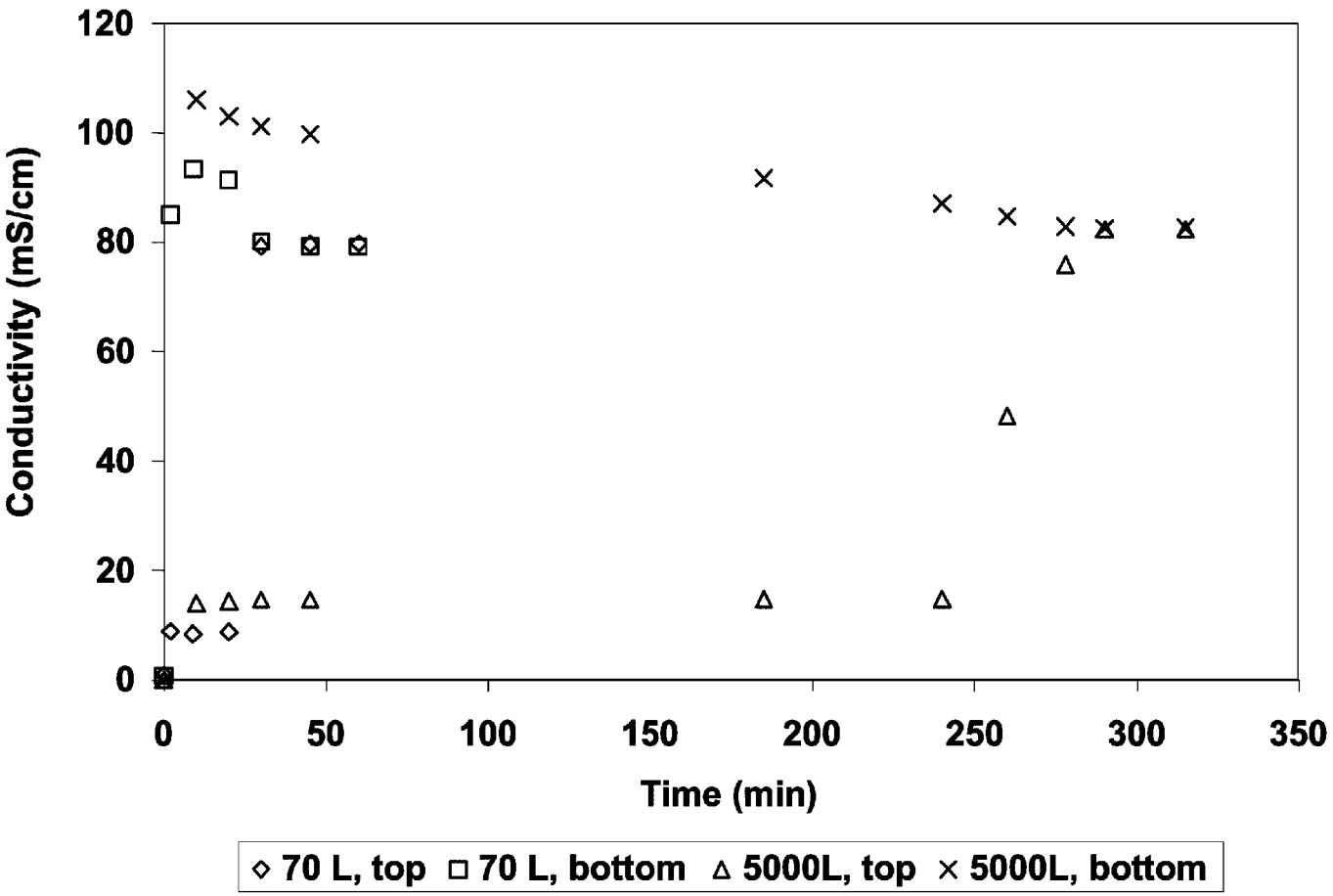
FIG. 5 represents a graph demonstrating dissolution time for a solute being added to a solvent.

Referring to FIG. 5, the diamonds represent the conductivity as measured by a probe near the top of a 70 L vessel, while the squares represent the conductivity as measured near the bottom of the 70 L vessel. After the solute has been added, it sinks to the bottom, thereby increasing the conductivity measured near the bottom of the vessel. This increases the conductivity at the bottom nearly immediately, while the top is relatively unaffected. However, the solute is then mixed in, as the top and bottom probes measure the same conductivity within 40 minutes. Several data points between 40 and 60 minutes demonstrate that the conductivity at the top and bottom have reached the same value.

The triangles and crosses represent the conductivity as measured near the top and bottom of a 5000 L vessel, respectively. As described with respect to the 70 L vessel, the NaCl causes the conductivity to increase almost immediately. However, due to the size of the vessel, it takes substantially longer for the salt to be mixed. FIG. 5 shows that the conductivities near the top and bottom of the vessel converge after nearly 5 hours.

For purposes of this disclosure, the dissolution time is defined to be the time at which the top and bottom conductivity readings are within 0.5 mS/cm of each other and no solute is visible at the bottom of the vessel.

Figure 6:
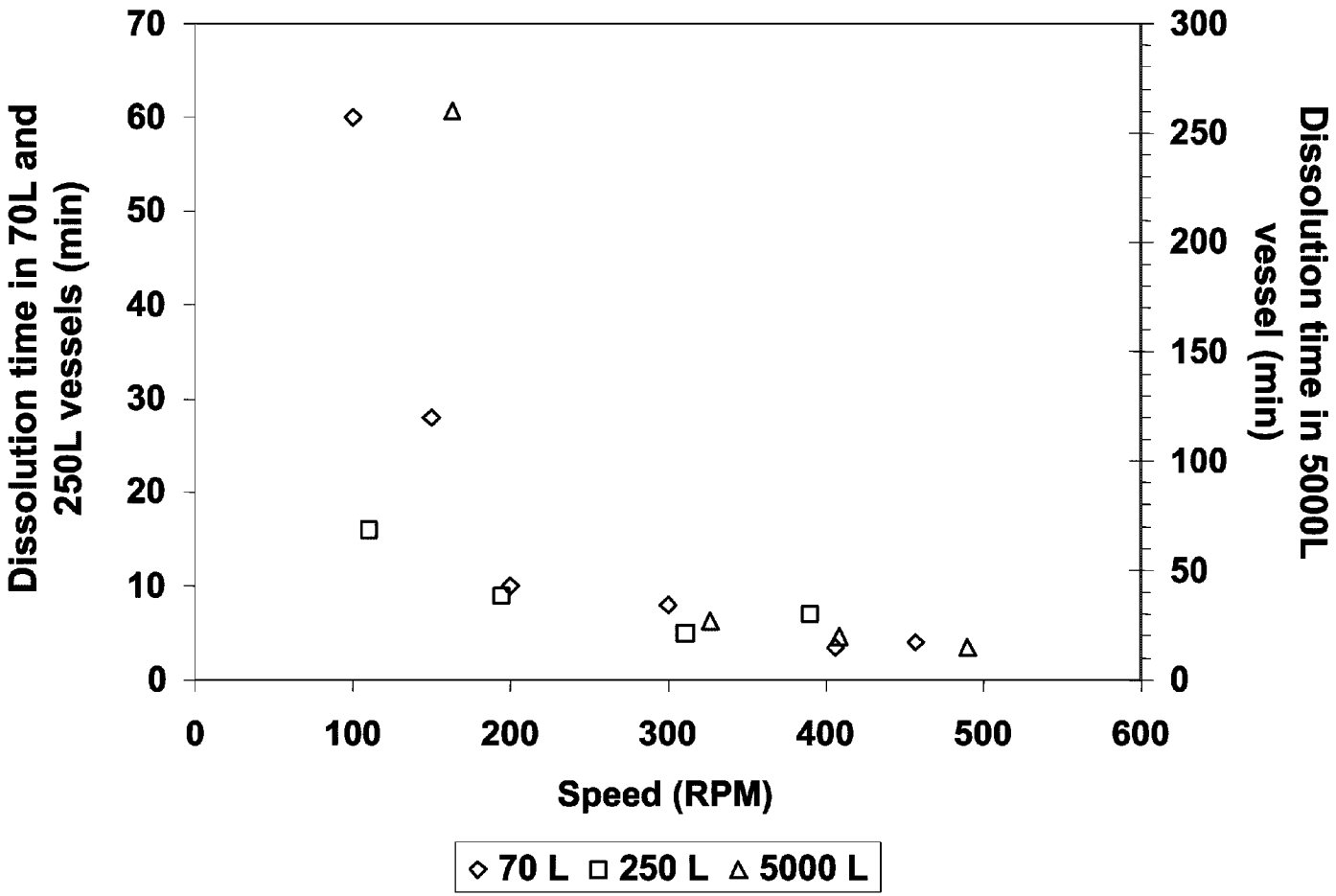
FIG. 6 represents a graph showing dissolution time as a function of impeller speed and vessel size.

FIG. 6 shows the solute dissolution times as a function of vessel size and impeller speed. The diamonds represent the 70 L vessel. Note that at very low RPM (100), the impeller was not effective in aiding the dissolution of the solutes resting on the bottom, thereby leading to the long dissolution time. As the impeller speed was increased, the dissolution time decreased significantly. A similar graph was also created for the 5000 L vessel, represented by the triangles, where a 200 RPM impeller was not able to dissolve the settled solute for almost 5 hours. Note that for a 250 L vessel, represented by the squares, the solute dissolution time was less sensitive to impeller speed.

As described above, Power/Volume can be used to characterize a mixing process, however, there is not a strong correlation between that value and mixing time as other factors also affect the process.

A second parameter often described as being useful in characterizing a mixing process is the Reynolds Number. The Reynolds Number is a measure of turbulence and is defined as:

$$R = \frac{\rho N D^2}{\mu} \tag{2}$$

Where:
ρ is fluid density,
N is impeller speed,
D is impeller diameter, and
μ is fluid viscosity.

Figure 7:
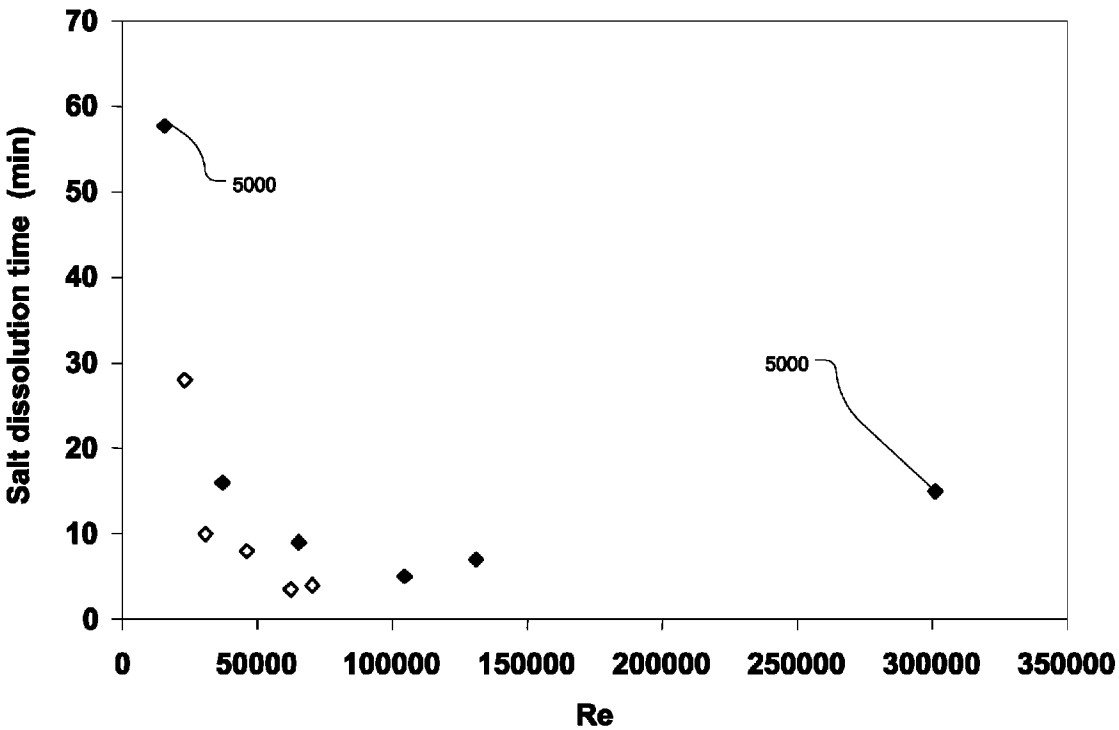
FIG. 7 represents a graph showing dissolution time as a function of Reynolds Number for various vessel sizes.

FIG. 7 represents a graph showing the solute dissolution time as a function of Reynolds Number. The two triangles labeled 5000 represent the dissolution times achieved with a 5000 L vessel. The hollow diamonds represent the 70 L dissolution times, while the solid diamonds represent the 250 L vessel. Again, as was the case with P/V, there does not appear to be correlation between the Reynolds Number and the solute dissolution time.

A third parameter that is sometimes considered is the amount of times the liquid turns over within the vessel. Similar to a pump, the liquid in the vessel is "pumped" by the mixer. The more volume the mixer is able to move, the more often the liquid will move from top to bottom within the vessel. This is defined by vessel turnover. Vessel turnover is defined by the mixer's pumping capacity divided by the volume of the vessel.

$$\text{Vessel_turnover} = \left(\frac{N_Q N D^3}{T^2 H}\right) \tag{3}$$

where
N=Mixer speed
D=Impeller diameter
ρ=fluid density
μ=fluid viscosity
T=Tank diameter
$N_Q$=Impeller Flow #
H=Liquid height in Tank A new term, mixing parameter, is defined to be a measure of the turbulence, mixing intensity and turn over time of a mixing process. Turbulence is defined by the Reynolds Number. Mixing intensity is defined as the square of the impeller diameter divided by the tank diameter. Turnover time is defined as the pumping capacity of the mixer/impeller as compared to the fluid volume. The term, MP, can be expressed as:

$$MP = \left(\frac{N D^2 \rho}{\mu}\right)\left(\frac{D}{T}\right)^2\left(\frac{N_Q N D^3}{T^2 H}\right) \tag{3}$$

where
N=Mixer speed
D=Impeller diameter
ρ=fluid density
μ=fluid viscosity
T=Tank diameter
$N_Q$=Impeller Flow #
H=Liquid height in Tank In other words, the product of these three components results in a parameter that can be used to determine mixing times. Most terms in this equation are self-evident. The fluid density and viscosity refer to the solvent. Mixer speed refers to the RPM of the impeller. The impeller flow number is a function of the shape and diameter of the impeller, and is typically characterized and supplied by the impeller vendor.

Figure 8:
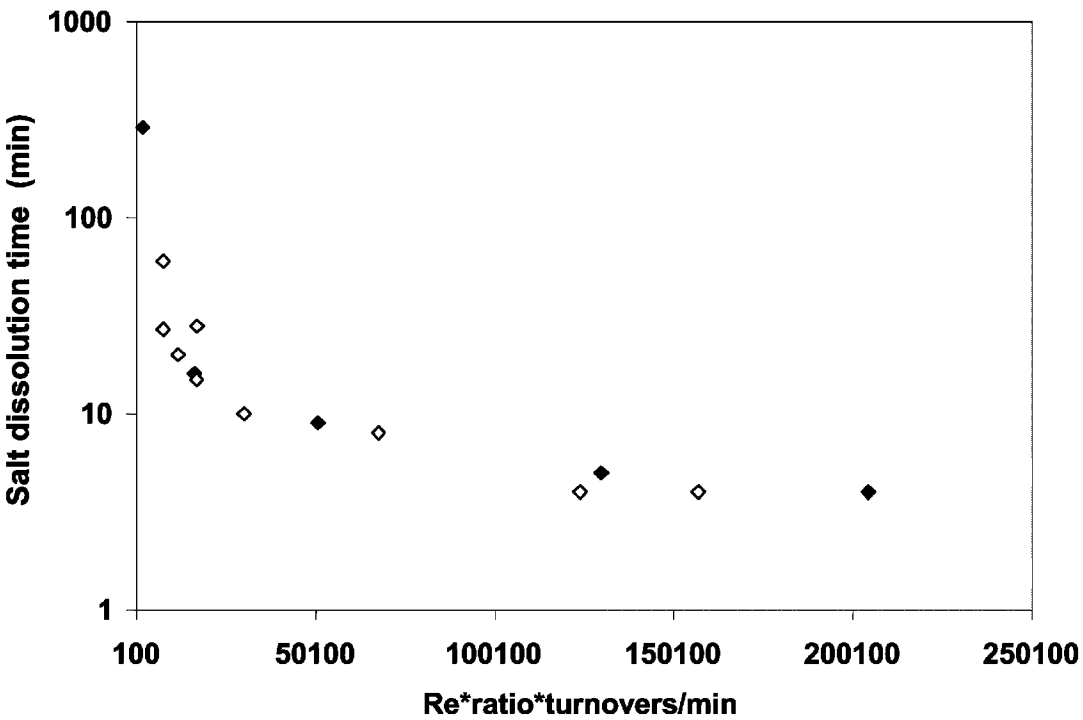
FIG. 8 represents a graph showing dissolution time as a function of MP for various vessel sizes.

FIG. 8 shows a graph of solute dissolution time as a function of MP. Dissolution times from 3 different sized vessels are included in this graph. Again, all data is collected using a GMP series impeller. The hollow diamonds represent times achieved using the 70 L vessel. The solid diamonds represent times achieved using the 250 L vessel, while the gray diamonds represent times achieved in the 5000 L vessel. Note that, unlike all previous graphs, there is a strong correlation between these two variables, even across different sized vessels.

Using standard line fitting techniques, it can be determined that this data can be fit to a curve of the general formula:

$$\text{Dissolution Time} = \alpha \times (MP)^{\beta} \tag{4}$$

In this specific embodiment, α was determined to be 69932 and β was determined to be −0.8268. This curve has a coefficient of determination ($R^2$) of 0.9, indicating that it is an accurate representation of the data points.

Therefore, MP can be used to predict solute dissolution time. While equation (3) shows one embodiment of the definition of mixing parameter (MP), others may also be possible. For example, this equation shows that dissolution time is related to Reynolds Number, mixing intensity and impeller power per unit fluid volume. Other expressions may also be used to create these three components. In other embodiments, this equation can be simplified. For example, if the same fluid is used throughout the testing, MP can be simplified to eliminate the terms associated with fluid density and viscosity. The simplified equation is written as:

$$MP = (ND^2)\left(\frac{D}{T}\right)^2\left(\frac{N_Q ND^3}{T^2 H}\right) \quad (5)$$

Other modifications and simplifications may also be possible, based on the actual test parameters.

Based on the information shown in FIG. 8, a process can be created, which allows an operator to determine dissolution times for any given vessel with a given impeller design, operating at any given speed. It is anticipated that changes to the configuration, such as different shaped vessels, different shaped impellers, fluids of differing viscosity and/or density, may change the coefficients of the above equation, but not its general form.

In one embodiment, the operator utilizes a smaller sized vessel, such as 70 L. The operator then prepares a test using the desired fluid and solutes. The Mixing Parameter (MP) of the configuration is determined using the equation for MP shown above. The operator then measures the solute dissolution time empirically as described above. The operator then performs a second test, varying at least one operating parameter. In some embodiments, all parameters are kept constant, except RPM (as this may be the easiest to change). The test is then repeated and a second solute dissolution time is found for this new MP. Based on these two data points, the coefficients, $\alpha$ and $\beta$, can be determined.

While the above example suggests modifying impeller RPM, other modifications are possible. For example, a different vessel or impeller diameter may be used. Alternatively, a different fluid, having a different viscosity and/or density may be used.

Once these two coefficients are determined, the operator can then calculate the theoretic solute dissolution time for another similarly shaped vessel, of any size vessel, operating at any RPM. The operator would simply calculate the MP for the desired configuration, and then use that calculated value of MP in equation (4) to find the solute dissolution time.

Figure 9:
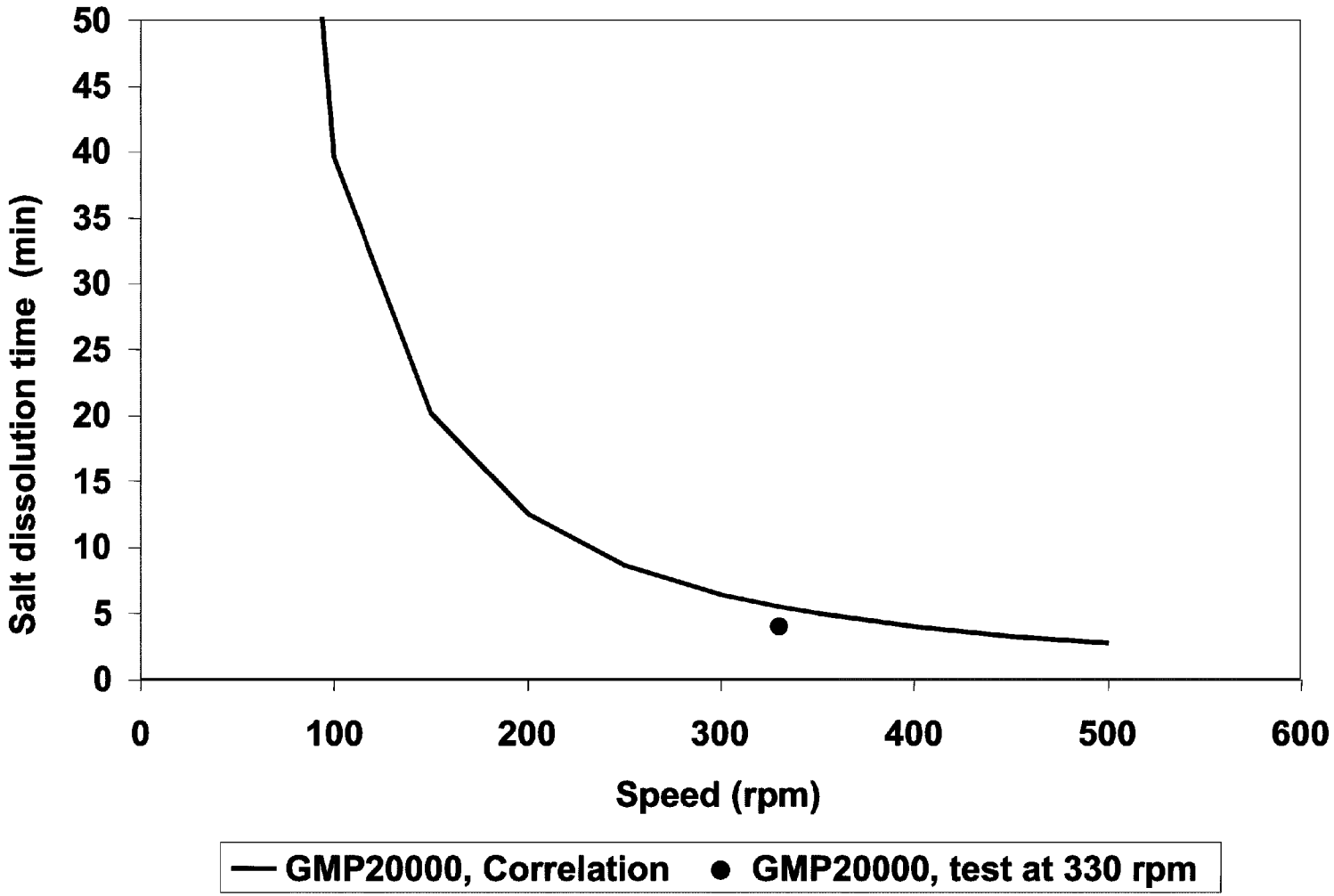
FIG. 9 shows a graph showing the projected dissolution times for a specific mixer (GMP20000) in a 5000 L vessel.

FIG. 9 shows a graph showing the projected dissolution times for a specific mixer (GMP20000) in a 5000 L vessel. The curve uses the equation (4) shown above, applying the unique characteristics of the particular mixer and vessel. The RPM is then varied to create the theoretic graph. The single data point on the graph is an actual measurement of the dissolution time of this configuration at 330 RPM. Note that the actual solute dissolution time is only seconds less than the theoretically calculated curve, thereby demonstrating the accuracy of the described method.

Thus, this process allows a straightforward, reliable method of scaling up the process parameters from a smaller vessel to a large, production scale vessel.

Figure 10:
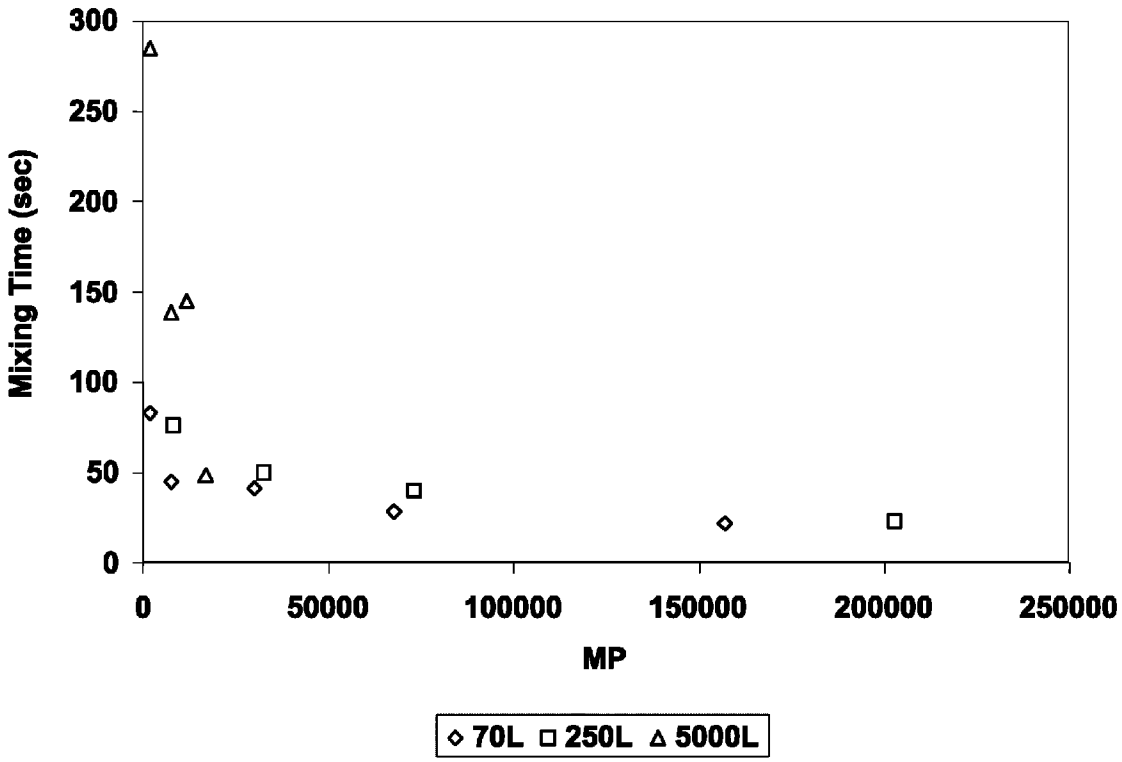
FIG. 10 shows the mixing times of FIG. 2 plotted against MP.

FIG. 10 shows the mixing times of FIG. 2 replotted, using MP as the independent variable. Note that the general shape exhibited in FIG. 8 is also apparent in the liquid/liquid mixing tests as well.

Additional testing was done, using a variety of impeller designs. An impeller design is defined to be a family of impeller having common attributes. For example, while the diameter of an impeller may change, all impellers within a product family may have similarly shaped blades and similar angular spacing between the blades. In other words, impellers within a particular product family display similar flow characteristics. In one experiment, three different impeller designs were used, a GMP series, USM series and HS series. All of these impellers are available from Millipore Corporation.

Figure 12:
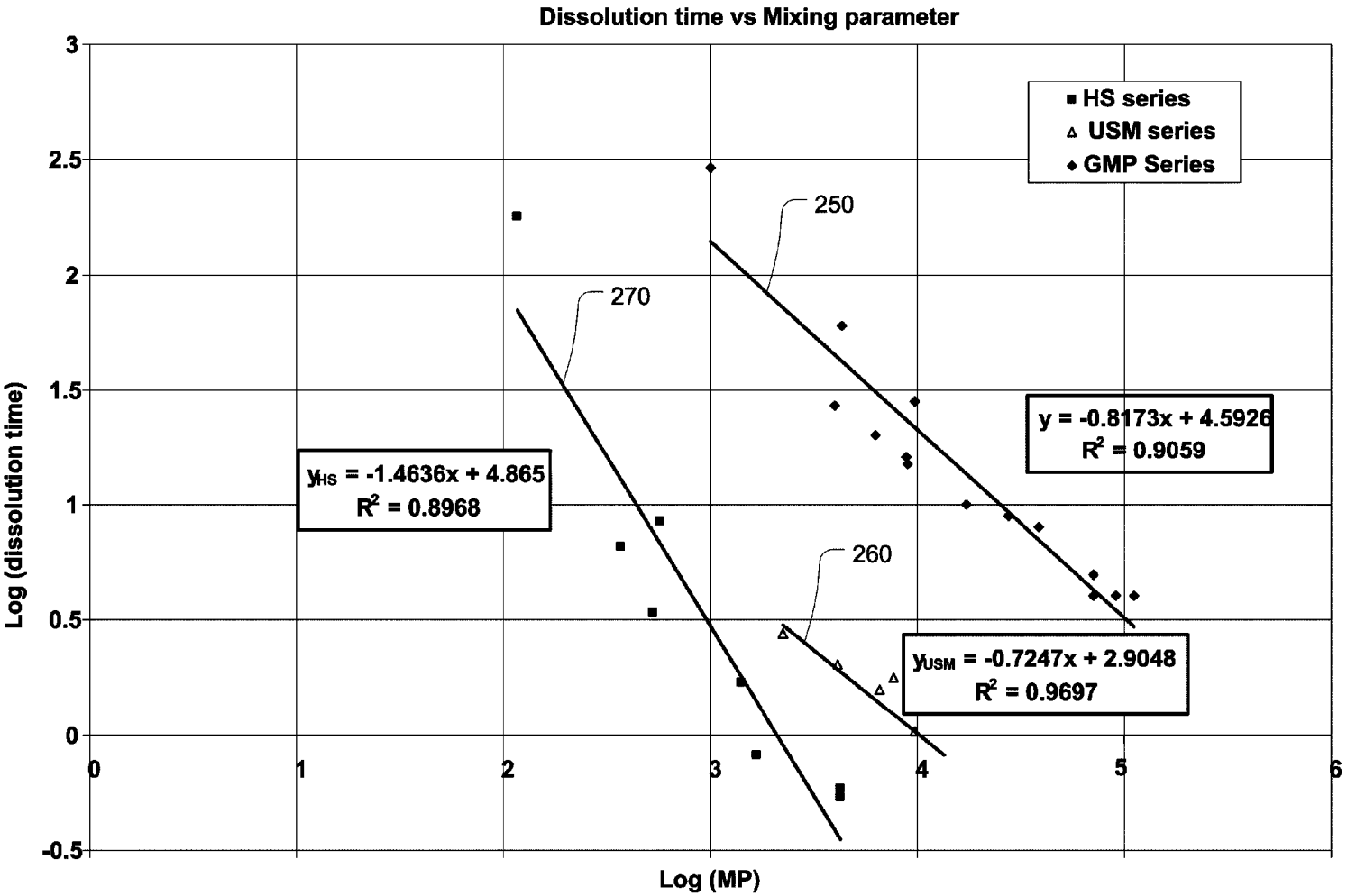
FIG. 12 shows a graph of dissolution time plotted against MP for various impeller designs and configurations.
Figure 13:
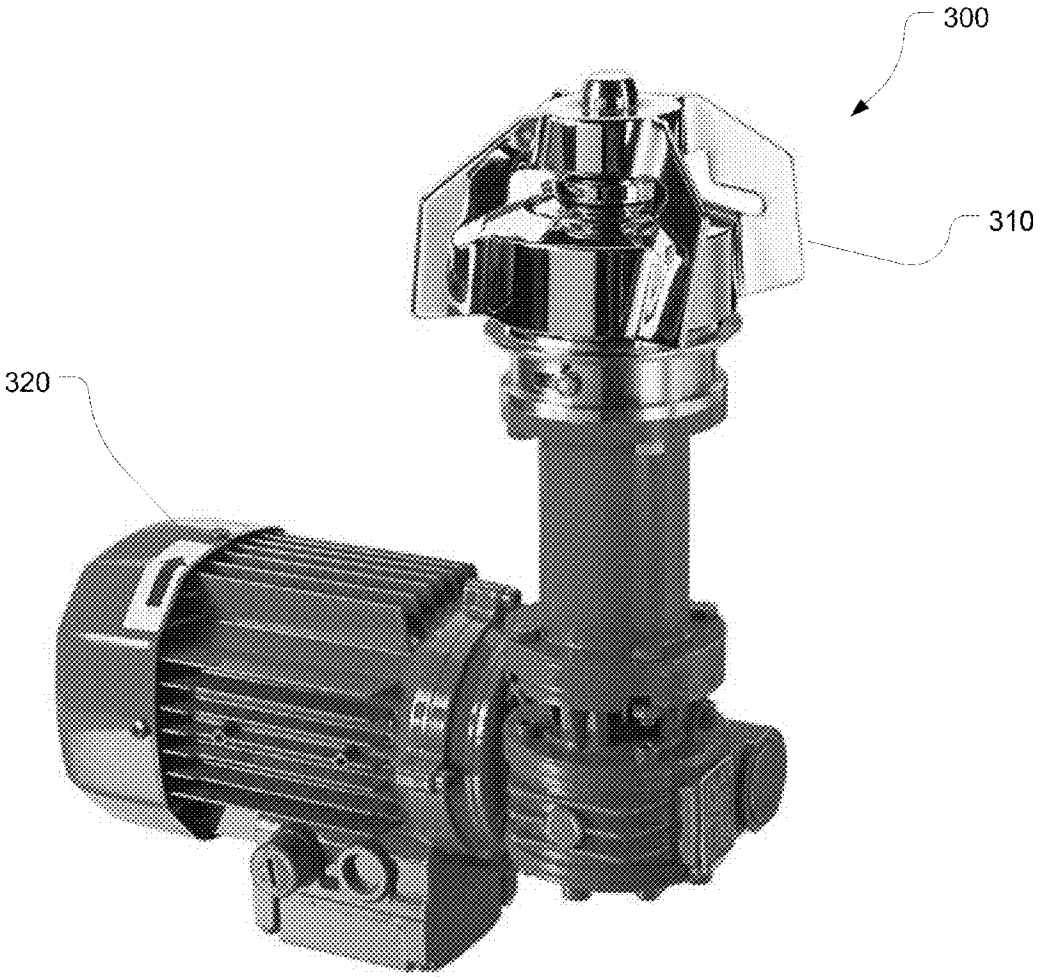
FIG. 13 is a representative embodiment of a GMP Series impeller.

The first was the GMP Series, an embodiment 300 of which is shown in FIG. 13, the data for which has been presented above, and is shown as line 250 in FIG. 12. The GMP Series impeller (mixing head) 300 has outwardly protruding blades 310, spaced roughly ¼ turn from one another. The mixer drive unit or motor 320 is affixed to the impeller by means of a shaft or magnetic coupling. When the motor rotates, it causes the blades of the impeller 320 to also rotate.

FIG. 12 shows a log-log graph of dissolution time versus MP. Based on equation (4), the results for each impeller design should result in a straight line, where the slope is $\beta$ and the y-intercept is the logarithm of $\alpha$.

The GMP test data was used to create line 250. This test data created a best fit line having a confidence level ($R^2$) of 0.9059, with a $\beta$ almost exactly that shown above.

Figure 14:
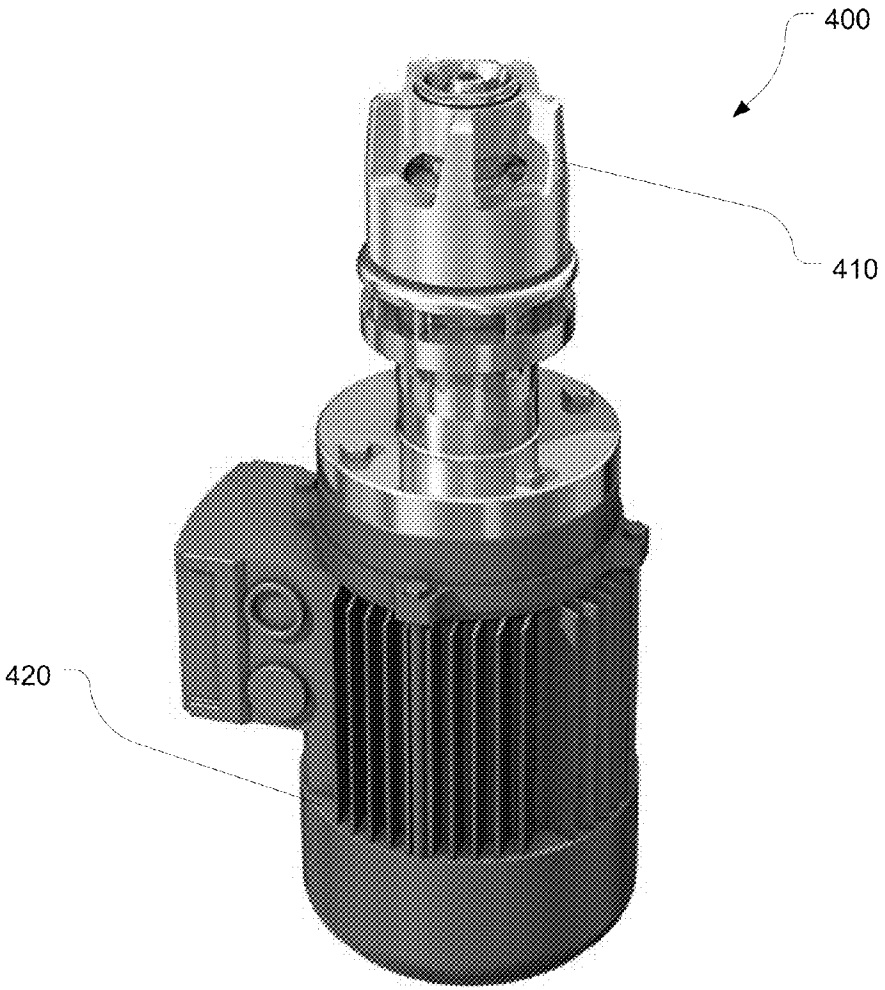
FIG. 14 is a representative embodiment of a UMS Series impeller.
Figure 15:
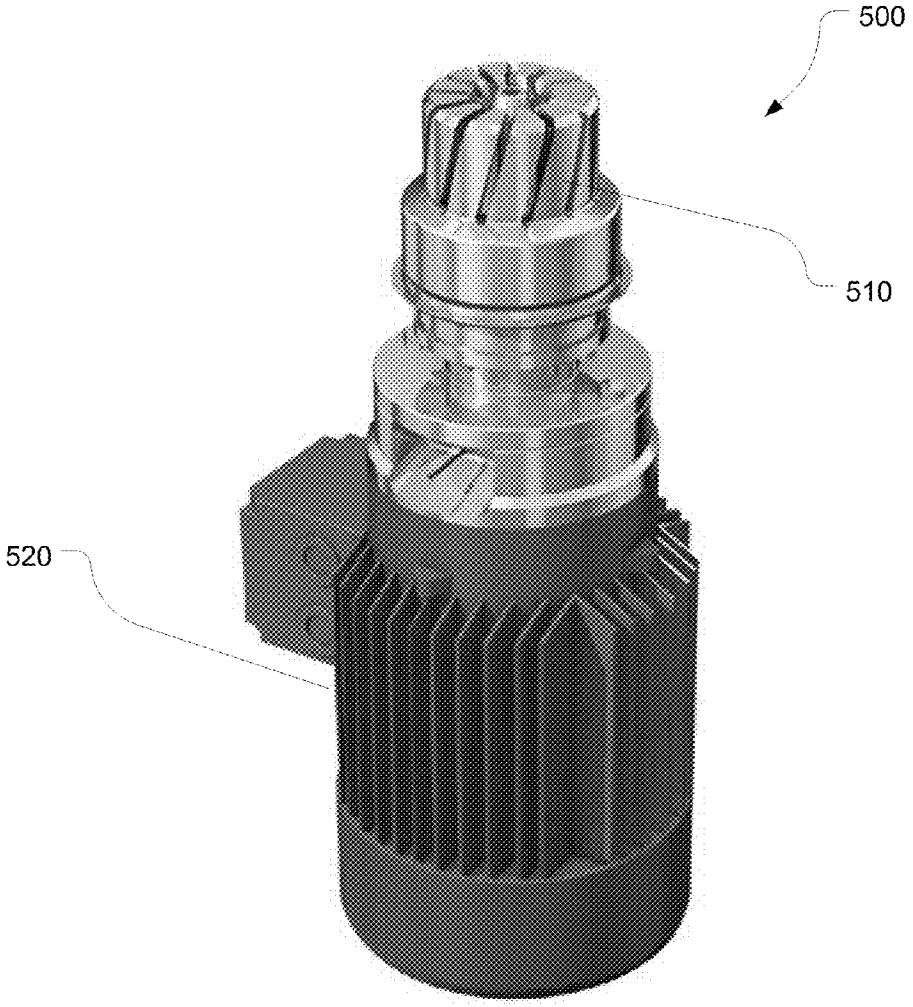
FIG. 15 is a representative embodiment of a HS Series impeller.

The second impeller design was a USM mixer (also known as an upstream mixer), an embodiment 400 of which is shown in FIG. 14. In this embodiment, five blades 410 are equally spaced. These blades are smaller in size than those used in GMP series impeller 300 and have different, identifiable fluid flow characteristics. These flow characteristics allow the USM mixer to be characterized (as the GMP mixer is) in terms of predictable performance. In addition, a mixer 420 is used to drive the impeller 400.

In this test, a single impeller diameter was used, while the RPM was varied. The vessel used was not changed. The five test points appear below:

TABLE 1

Test configurations for USM mixer

| Impeller | Vessel | Vessel Working | |
|---|---|---|---|
| dia (mm) | dia (mm) | Volume (L) | RPM |
| 104 | 1200 | 610 | 665 |
| 104 | 1200 | 610 | 900 |
| 104 | 1200 | 610 | 1388 |
| 104 | 1200 | 610 | 1140 |
| 104 | 1200 | 610 | 1630 |

The data was graphed as line 260 on FIG. 12. As expected, the logarithm of the dissolution times varied linearly with the log of the MP mixing parameter, as shown in FIG. 12. Note that the slope ($\beta$) and y-intercept ($\log(\alpha)$) changed, as compared to lines 250 and 270, as the impeller designs are different for each line. Again, the confidence ($R^2$) in this approximately was very high, having a value of 0.9697.

The third impeller design was a HS mixer (also known as a high sheer mixer), an embodiment 500 of which is shown in FIG. 14. In this embodiment, the individual blades 410 are spaced close together and the impeller is positioned with respect to the stator to maximize sheer. In addition, a mixer 420 is used to drive the impeller 400. In this test, the impeller diameter was varied, as was the diameter and volume of the vessel. The test points appear below:

TABLE 2

Test configurations for HS mixer

| Impeller | Vessel | Vessel Working | |
|---|---|---|---|
| dia (mm) | dia (mm) | Volume (L) | RPM |
| 41 | 394 | 75 | 1500 |
| 41 | 394 | 75 | 1800 |
| 41 | 394 | 75 | 3190 |
| 41 | 394 | 75 | 5100 |

TABLE 2-continued

| Test configurations for HS mixer | | | |
|---|---|---|---|
| Impeller | Vessel | Vessel Working | |
| dia (mm) | dia (mm) | Volume (L) | RPM |
| 65 | 790 | 610 | 1000 |
| 65 | 790 | 610 | 2200 |
| 65 | 790 | 610 | 3500 |

The data is plotted as line 270 on FIG. 12. Again, even with different impeller diameters, different RPMs and different vessel diameters and volumes, a straight-line approximation is still accurate, having a confidence level confidence ($R^2$) of nearly 0.9.

Thus, the data shows that, for a particular impeller design, the dissolution time of a mixture can be approximated by equation (4) given above. Thus, a small sample can be prepared in one vessel, and at a later time, the size and volume of the vessel can be increased, the impeller diameter and RPM can be varied, and the above equation still provides an accurate estimate of the dissolution time.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

What is claimed is:

1. A method of determining the salt dissolution time of a salt into a fluid in a first configuration, said configuration having a vessel of a first size, a first impeller and a first mixer operating at a first RPM, comprising:

a. calculating a first mixing parameter (MP) for said first configuration, said parameter defined as $$MP = (ND^2)\left(\frac{D}{T}\right)^2\left(\frac{N_Q ND^3}{T^2 H}\right),$$

where N comprises the RPM of said mixer, D comprises the diameter of said impeller, $N_Q$ comprises the power number of said impeller, T comprises the diameter of said vessel, and H comprises the height of said fluid in said vessel;

b. creating a second configuration, using a vessel of a second size, said fluid, said salt, a second impeller and a second mixer operating at a second RPM;

c. calculating a second mixing parameter (MP) for said second configuration;

d. determining a salt dissolution time for said second configuration;

e. creating a third configuration, using a vessel of a third size, said fluid, said salt, a third impeller and a third mixer operating at a third RPM;

f. calculating a third mixing parameter for said third configuration;

g. determining a salt dissolution time for said third configuration;

h. determining two coefficients, α and β, such that said second mixing parameter and its associated salt dissolution time, and said third mixing parameter and its associated salt dissolution time, both satisfy the equation:

$$\text{Dissolution Time} = \alpha \times (MP)^{\beta}; \text{ and}$$

i. determining the salt dissolution time of said first configuration based on said first mixing parameter, α and β.

2. The method of claim 1, wherein a diameter of said second impeller and a diameter of said third impeller are the same and a power number of said second impeller and a power number of said third impeller are the same.

3. The method of claim 1, wherein said second mixer and said third mixer are the same.

4. The method of claim 1, wherein said second size and said third size are the same.

5. The method of claim 1, where said first size is greater than said second and third sizes.

6. The method of claim 1, wherein a diameter of said second impeller and a diameter of third impeller are the same, a power number of said second impeller and a power number of said third impeller are the same, said second mixer and said third mixer are the same, said second size and said third size are the same, and said second RPM differs from said third RPM.

7. The method of claim 6, wherein said first size is greater than said second and third sizes.

8. A method of determining the salt dissolution time of a salt into a first fluid in a first configuration, said configuration having a vessel of a first size, a first impeller and a first mixer operating at a first RPM, comprising:

a. calculating a first mixing parameter (MP) for said first configuration, said parameter defined as $$MP = \left(\frac{ND^2\rho}{\mu}\right)\left(\frac{D}{T}\right)^2\left(\frac{N_Q ND^3}{T^2 H}\right),$$

where N comprises the RPM of said mixer, D comprises the diameter of said impeller, ρ comprises the density of said fluid, μ comprises the viscosity of said fluid, $N_Q$ comprises the power number of said impeller, T comprises the diameter of said vessel, and H comprises the height of said fluid in said vessel;

b. creating a second configuration, using a vessel of a second size, a second fluid, said salt, a second impeller and a second mixer operating at a second RPM;

c. calculating a second mixing parameter (MP) for said second configuration;

d. determining a salt dissolution time for said second configuration;

e. creating a third configuration, using a vessel of a third size, a third fluid, said salt, a third impeller and a third mixer operating at a third RPM;

f. calculating a third mixing parameter for said third configuration;

g. determining a salt dissolution time for said third configuration;

h. determining two coefficients, α and β, such that said second mixing parameter and its associated salt dissolution time, and said third mixing parameter and its associated salt dissolution time, both satisfy the equation:

$$\text{Dissolution Time}=\alpha\times(MP)^{\beta}; \text{ and}$$

i. determining the salt dissolution time of said first configuration based on said first mixing parameter, $\alpha$ and $\beta$.

9. The method of claim 8, wherein a diameter of said second impeller and a diameter of said third impeller are the same, and a power number of said second impeller and a power number of said third impeller are the same.

10. The method of claim 8, wherein said second mixer and said third mixer are the same.

11. The method of claim 8, wherein said second size and said third size are the same.

12. The method of claim 8, where said first size is greater than said second and third sizes.

13. The method of claim 8, wherein said second fluid and said third fluid are the same.

14. The method of claim 8, wherein a diameter of said second impeller and a diameter of third impeller are the same, a power number of said second impeller and a power number of said third impeller are the same, said second mixer and said third mixer are the same, said second size and said third size are the same, and said second RPM differs from said third RPM.

* * * * *